United States Patent [19]

Marionneaux

[11] Patent Number: 4,657,430

[45] Date of Patent: Apr. 14, 1987

[54] ROADWAY AND ROADWAY EXPANSION JOINT

[76] Inventor: John L. Marionneaux, Rt. 3, Box 212, Prairieville, La. 70769

[21] Appl. No.: 618,328

[22] Filed: Jun. 8, 1984

Related U.S. Application Data

[63] Continuation-in-part of Ser. No. 460,644, Jan. 24, 1983, abandoned.

[51] Int. Cl.[4] ..... E01C 11/02

[52] U.S. Cl. ..... 404/74; 404/47

[58] Field of Search ..... 404/47, 50, 55, 57, 404/58, 60, 68, 69, 74, 75, 87, 48; 52/595; 125/14

[56] References Cited

U.S. PATENT DOCUMENTS

| | | | |
|---|---|---|---|
| 1,098,792 | 6/1914 | Ficklen | 404/69 |
| 1,241,405 | 9/1917 | Leach | 404/50 |
| 1,369,161 | 2/1921 | Benson | 404/47 |
| 1,806,275 | 5/1931 | Adler | 404/50 |
| 2,130,859 | 9/1938 | Robertson | 404/58 |
| 2,133,059 | 10/1938 | Snelling | 404/74 |
| 2,280,455 | 4/1942 | Seuberling | 404/48 |
| 2,311,286 | 2/1943 | Tufts | 404/50 |
| 2,791,412 | 5/1957 | Hatcher | 404/87 X |
| 3,179,026 | 4/1965 | Crone | 404/47 |
| 3,256,786 | 6/1966 | Middlestadt | 404/50 |
| 3,276,334 | 10/1966 | Rhodes | 404/74 |
| 3,577,896 | 5/1971 | Finsterwalder et al. | 404/74 |
| 3,625,808 | 12/1971 | Martin | 52/595 X |
| 3,797,190 | 3/1974 | Widdowson | 52/595 |
| 3,880,541 | 4/1975 | McDowell et al. | 404/74 |
| 3,972,640 | 8/1976 | Miller | 404/60 |
| 4,107,892 | 8/1978 | Bellem | 52/595 X |
| 4,332,504 | 6/1982 | Arai | 404/68 |
| 4,456,303 | 6/1984 | Due | 125/14 X |

FOREIGN PATENT DOCUMENTS

| | | | |
|---|---|---|---|
| 36043 | 11/1965 | German Democratic Rep. | 404/50 |

*Primary Examiner*—Stephen J. Novosad
*Assistant Examiner*—Matthew Smith
*Attorney, Agent, or Firm*—William D. Kiesel; Robert C. Tucker

[57] ABSTRACT

An improved roadway and roadway expansion joint is provided, wherein at least some of the adjacent slabs, comprising the roadway, are parallelogram-in-shape and have complementary angles adjacent abutting ends.

1 Claim, 3 Drawing Figures

ROADWAY AND ROADWAY EXPANSION JOINT

This application is a continuation-in-part of copending application Ser. No. 460,644 filed Jan. 24, 1983 and now abandoned.

BACKGROUND OF THE INVENTION

1. Field of the Invention

This invention relates, in general, to concrete roads and pavements, and, more particularly, to an improved roadway expansion joint and method for prevention of pavement buckling.

2. Prior Art

Concrete roads are usually constructed of separate, longitudinally aligned molded slabs, each of which is poured in place with the vertical ends of the slab spaced slightly away from the end of a previously poured slab. After the slabs have set, the joints between their ends are sealed with a thermoplastic sealing material, such as asphalt, sufficient space being left between the slabs to accommodate the expansion thereof due to the normally elevated temperatures of summer. However, when temperatures rise to abnormally high levels, the total expansion of a number of slabs exceeds the combined space between their ends with the result that at certain joints the ends of the slabs butt up solidly against each other with such immense force that the ends buckle, often explosively, with spalling and pulverization of the slabs extending in both directions from the joint over several feet. Obviously, driving on a road which has been damaged in this manner is dangerous and satisfactory repairs can only be effected by removing the broken material and pouring fresh concrete, which prolongs the period that a road is impassable due to heat buckling.

Another major problem has been the accumulation of dirt, rocks or other trash in the roadway joint which results in quicker deterioration of the roadways.

All of these problems require immediate attention which results many times in major highways being partially or completely closed during peak traffic times or during weekends.

Many proposed solutions of these problems have been disclosed, such as those seen in the following patents:

| U.S. Pat. No. | Inventor | Issued | Title |
|---|---|---|---|
| Des. 261,555 | Bowman | 10/27/81 | Expansion Joint Sealing Strip for Roadway Joints and the Like |
| Des. 261,046 | Bowman | 09/29/81 | Expansion Joint Sealing Strip Assembly for Roadways and the Like |
| Des. 261,045 | Bowman | 09/29/81 | Expansion Joint Sealing Strip for Roadway Joints and the Like |
| Des. 260,684 | Bowman | 09/08/81 | Expansion Joint Sealing Strip for Roadway Joints |
| Des. 260,557 | Bowman | 09/01/81 | Expansion Joint Sealing Strip Assembly for Roadways Joints |
| 3,245,328 | Fassbinder | 04/12/66 | Expansion Joint for Road Covering Structures |

-continued

| U.S. Pat. No. | Inventor | Issued | Title |
|---|---|---|---|
| 3,324,774 | Boschi | 06/13/67 | Expansion Joint for Road Sections |
| 3,273,473 | Pare | 09/20/66 | Road Expansion Joint |
| 3,316,574 | Pare | 05/02/67 | Road Expansion Joint |
| 3,427,935 | Boschi | 02/18/69 | Expansion Joint for Roads and Bridges |
| 3,677,145 | Wattlez | 07/18/72 | Expansion Joint for Road Works |
| 3,720,474 | Stog, et al | 03/13/73 | Expansion Joint |
| 3,826,583 | Pare | 07/30/74 | Leaf Spring Pavement Joint Seal |
| 3,851,989 | Peach | 12/03/74 | Expansion Joint for Slabs of Concrete Roadways |
| 3,877,829 | Honegger | 04/15/75 | Roadway Expansion Joint |
| 3,899,261 | Mieville | 08/12/75 | Expansion Joint Batten or Packing of Dilation Joint |
| 3,904,304 | Honegger | 09/09/75 | Expansion Joints for a Roadway |
| 3,972,640 | Miller | 08/03/76 | Highway Joint with Spring Torsion Bar |
| 4,076,440 | Bertschmann | 02/28/78 | Expansion Joint Bridging Device |
| 4,087,191 | Brady, et al | 05/02/78 | Large Motion Expansion Joint |
| 4,279,533 | Peterson, et al | 07/21/81 | Roadway Expansion Joint |
| 1,369,161 | Benson, et al | 2/22/21 | Pavement |

However, for a multitude of reasons, such prior art devices have been found not to work or have been impractical.

SUMMARY OF THE INVENTION

Therefore, it is an object of this invention to provide a roadway and a roadway expansion joint which eliminates roadway buckling.

Another object of this invention is to provide a roadway expansion joint which helps eliminate any dirt, rocks, etc., which might get into the joint.

Other objects and advantages of this invention shall become apparent from the ensuing descriptions of the invention.

Still another object of this invention is to provide a roadway expansion joint that allows additional time to plan for repairing any damaged sections of the roadway.

A further object of this invention is to provide a method for predicting and eliminating roadway buckling before it occurs.

Accordingly, a roadway is provided comprising an adjacent series of concrete slabs, each having laterally spaced sides and transverse ends, wherein at least some of said adjacent slabs are parallelogram in shape such that each pair of abutting ends of said adjacent slabs form a joint running obliquely across said roadway.

PREFERRED EMBODIMENTS OF THE INVENTION

Figure 1:
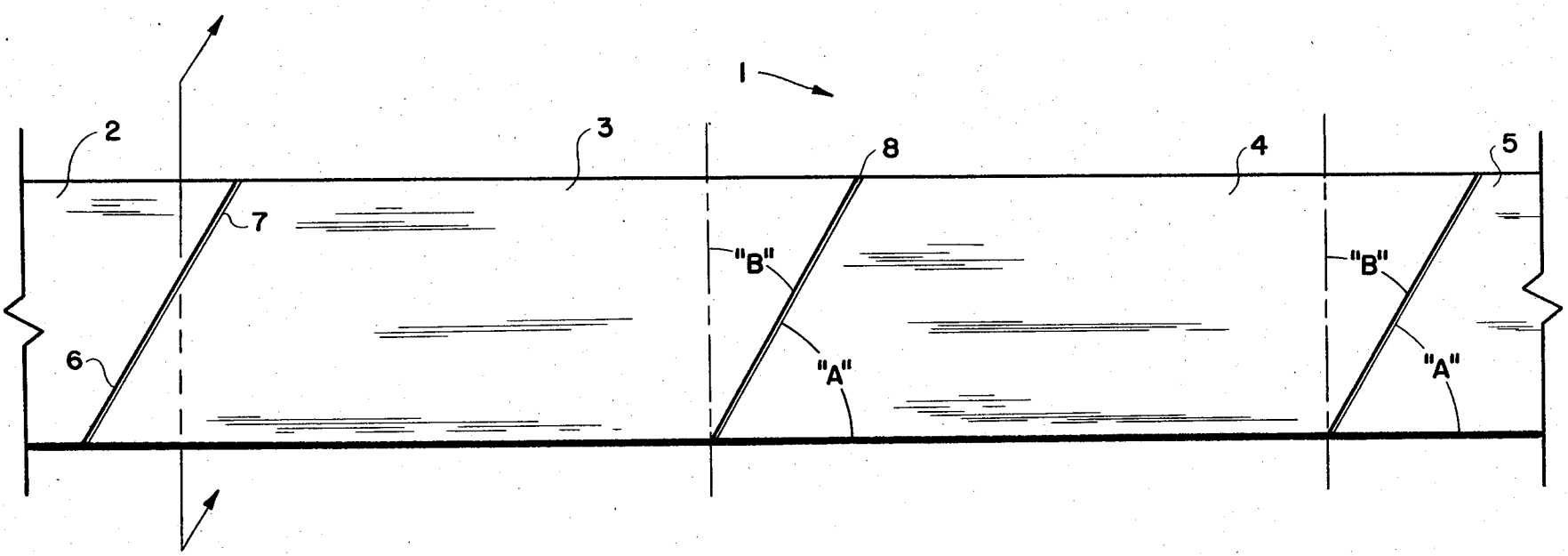
FIG. 1 is a top view of a portion of a roadway utilizing a roadway expansion joint of this invention.

Turning now to FIG. 1, a top view of a partial roadway 1 is shown comprising adjacent slabs 2–5 of poured concrete, each of which is parallelogram-in-shape and having the adjacent ends 6 and 7 shaped to form complementary angles "A" and "B" with one another. In a preferred embodiment, angle "A" and "B" will be between 30°–60°. A small gap 8 remains between ends 6 and 7 to form an oblique expansion joint to accommodate the expansion and contraction of slabs 2–5 during normal temperature changes.

It has now been found that by shaping the slabs as shown during abnormal temperature changes that occur, the adjacent slabs will slide against one another rather than butt one another, eliminating the likelihood of buckling.

Figure 3:
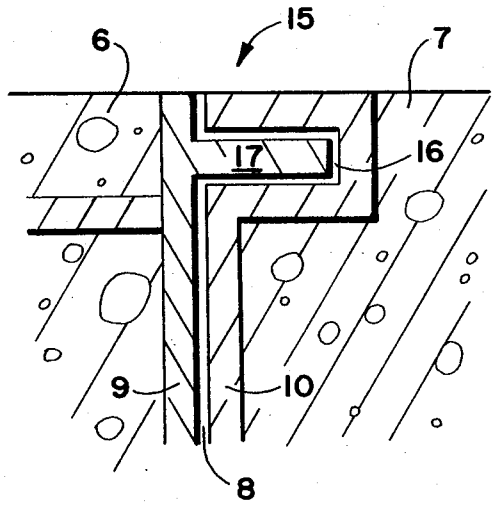
FIG. 3 is a cross-sectional view of Detail A of FIG. 2 illustrating a preferred embodiment of a trash seal for the roadway expansion joint.
Figure 2:
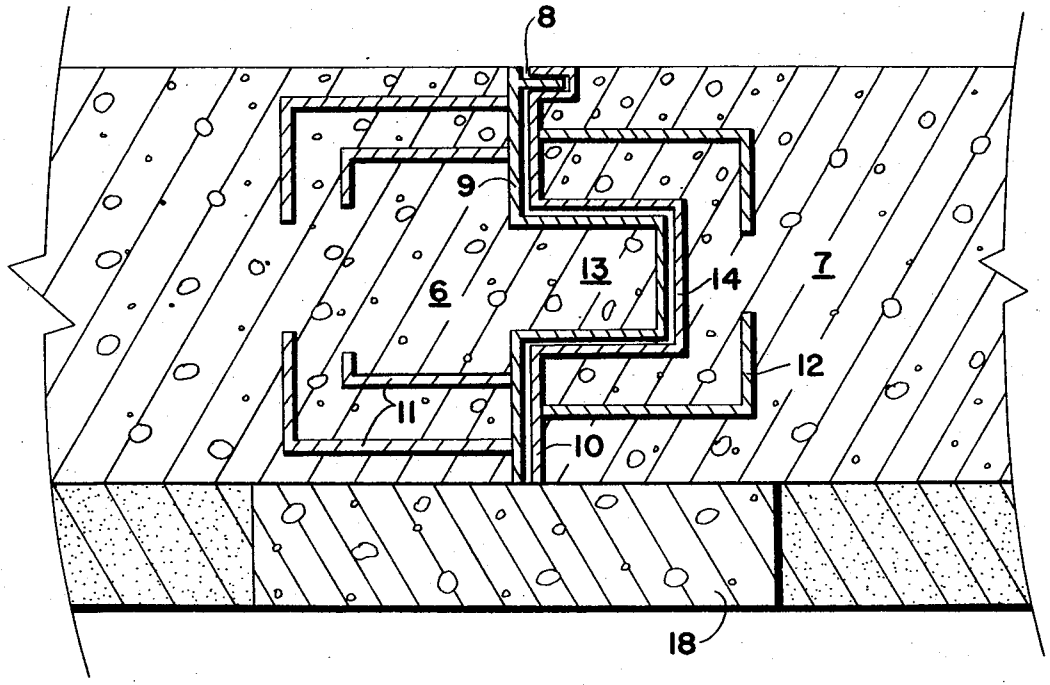
FIG. 2 is a cross-section view taken along lines 1—1 of FIG. 1 illustrating a preferred embodiment of the roadway expansion joint.

In a preferred embodiment, as seen in FIGS. 2 and 3, metal plates 9 and 10 are fixed to slab ends 6 and 7, respectively, by anchor pins 11 and 12, respectively. The metal plates 9 and 10 not only help protect the concrete ends 6 and 7 from chipping, etc., but also provide a smoother surface for the slabs to slide against.

In a more preferred embodiment slab ends 6 and 7 will be designed with mating tongue 13 and groove 14 to guide the direction of the sliding motion and to prevent the slabs from rising. If metal plates 9 and 10 are employed, it is preferred that they also be tongue-and-grooved as shown.

In another preferred embodiment, as seen in FIG. 3, a trash seal 15 to prevent rocks and similar material from entering gap 8 is provided. Seal 15 is formed by forming a groove 16 in metal plate 10 extending across the width of slab 7 and then providing a mating lip 17 to plate 9 that extends into groove 16. In this manner, gap 8 is kept relatively clean and allows for easier sliding of slabs 3 and 4, as well as prevents damage to either slab ends 6 and 7 or plates 9 and 10.

In another preferred embodiment, a concrete block 18 can be placed under gap 8 to eliminate any load transfer problems which might occur due to road bed deterioration.

A method of roadway inspection has been developed utilizing the expansion joint of this invention which results in only minor highway outage and eliminates pavement buckling entirely. Once a section of roadway is constructed utilizing the expansion joint of this invention, a highway inspector need only periodically drive along the roadway, observing either the roadway centerline or the roadway edge. If the pavement expands beyond what is allowed by the expansion joint space between the slabs, the design of this invention will allow adjacent slabs to horizontally slide relative to one another rather than creating a potential vertical buckling situation, resulting in roadway centerline or edge displacement which may be readily detected upon visual examination by highway inspectors. Excessive pressure on the roadway may then be relieved by cutting at least one additional oblique expansion joint completely through the pavement near the joint on which displacement has occurred. Such cutting may be accomplished by utilizing a concrete saw, causing relatively little inconvenience to traffic and saving the tremendous costs and inconvenience involved in breaking out and rebuilding a buckled joint.

There are, of course, obvious modifications and alternate features not specifically disclosed, but which are intended to be included within the scope of this invention as defined by the following claims.

What I claim is:

1. A method for prevention of pavement buckling comprising the steps of:

a. constructing a roadway comprising an adjacent series of concrete slabs, each having laterally spaced sides and transverse ends, wherein at least some of said adjacent slabs are parallelogram in shape such that each pair of abutting ends of said adjacent slabs form a joint running obliquely across said roadway.

b. inspecting said roadway for horizontal relative movement between said abutting ends along said oblique joints.

c. constructing at least one additional oblique expansion joint in each area of said roadway where said relative movement is detected before buckling.

* * * * *